US007377988B2

(12) United States Patent
Griffin et al.

(10) Patent No.: US 7,377,988 B2
(45) Date of Patent: May 27, 2008

(54) POSITIONAL FIXING OF A SHAFT

(75) Inventors: Joseph Traywick Griffin, Charlotte, NC (US); Marion Jack Ince, Mount Holly, NC (US); Charles M. Schwab, Fort Mill, SC (US); Eric S. Nelson, Charlotte, NC (US); Richard S. Carpenter, Rock Hill, SC (US)

(73) Assignee: INA Schaeffler KG, Herzogenaurach (DE)

( * ) Notice: Subject to any disclaimer, the term of this patent is extended or adjusted under 35 U.S.C. 154(b) by 322 days.

(21) Appl. No.: 10/410,938

(22) Filed: Apr. 10, 2003

(65) Prior Publication Data

US 2004/0000280 A1 Jan. 1, 2004

Related U.S. Application Data

(60) Provisional application No. 60/391,818, filed on Jun. 27, 2002.

(51) Int. Cl.
*F01L 1/18* (2006.01)
*F16C 35/06* (2006.01)

(52) U.S. Cl. ..... 148/320; 123/90.44; 384/587

(58) Field of Classification Search ..... 148/639, 148/570, 572, 218, 906
See application file for complete search history.

(56) References Cited

U.S. PATENT DOCUMENTS 4,816,090 A * 3/1989 Doonan et al. ..... 148/320
5,054,440 A * 10/1991 Kadokawa ..... 123/90.5
6,126,897 A * 10/2000 Aihara et al. ..... 420/106
6,598,571 B1 * 7/2003 Harimoto et al. ..... 123/90.44
2002/0040743 A1 * 4/2002 Hirakawa et al. ..... 148/318
2003/0037635 A1 * 2/2003 Tsuchiyama et al. ..... 74/569

OTHER PUBLICATIONS

"fixing." Webster's Online Dictionary. 2007. http://lionreference.chadwyck.com/initRefShelfSearch.do?initalise=true &listType=mwd (Jun. 7, 2007).

"fixing." Dictionary.com. Lexico Publishing Group. Retrieved Jun. 7, 2007, from http://dictionary.reference.com/browse/fixing.

* cited by examiner

*Primary Examiner*—Roy King
*Assistant Examiner*—Jessee Roe
(74) *Attorney, Agent, or Firm*—Charles A. Muserlian

(57) ABSTRACT

The invention concerns the fixing of a bearing shaft (6) in a reception bore (1.3) of a housing, at least one end of the shaft being adapted to be swaged to the reception bore (1.3) for achieving at least one of a force locking and a positive engagement, and an outer peripheral surface of the shaft (6) having a hardness that is greater than a hardness of the ends (6.2) of the shaft. The novel shaft is carbonitrided, quenched and tempered so that at first a hardness of HV 745-950 (HRC 62-68) is realized, following which the thus treated shaft (6) is soft annealed to produce a hardness of HV 212-305 (HRB 93-HRC30), and the outer peripheral surface is then subjected to induction hardening to achieve a final hardness of HV 745-950 (HRC 62-68). The shaft of the invention has a long operating life even under high load conditions.

6 Claims, 2 Drawing Sheets

POSITIONAL FIXING OF A SHAFT

PRIOR APPLICATIONS

This application claims the benefit of Provisional Application Ser. No. 60/391,818 filed Jun. 27, 2002.

FIELD OF THE INVENTION

The invention concerns a fixing of a bearing shaft in a reception bore of a housing, at least one end of the shaft being adapted to be swaged to the reception bore for achieving at least one of a force locking and a positive engagement, and an outer peripheral surface of the shaft having a hardness that is greater than a hardness of ends of the shaft.

BACKGROUND OF THE INVENTION

A shaft of the pre-cited type for mounting the cam-actuated roller of a rocker arm is known from U.S. Pat. No. 5,054,440. This rocker arm has a bifurcated section with two side walls each of which comprises a reception bore through which the bearing shaft is inserted. The shaft carries a roller that is mounted through needle bearing rollers and is actuated by a cam. The shaft is retained in the reception bore by swaging which means that one or both ends of the shaft are worked with an appropriate tool so that a part of the material of the shaft is displaced in a radial direction into the reception bore.

Due to the fact that, on the one hand, the bearing shaft supports a raceway of a rolling element crown ring and, on the other hand, this shaft is retained in the rocker arm by swaging, it has to be both hard and soft. These diametrically opposed properties of the shaft have been realized in the prior art by subjecting the raceway region to a hardening treatment while leaving the ends of the shaft untreated so that they remain soft. In the case of U.S. Pat. No. 5,054,440, the raceway region of the shaft is subjected to a hardening treatment that produces a hardness of 640-840 HV in this region, while the ends of the shaft are left untreated and thus possess a hardness of 200-336 HV.

When used under high load conditions which, for example, in planetary pinion bearings for automatic transmissions can reach a multiple of the acceleration due to gravity, these shafts have a relatively short operating life.

OBJECT OF THR INVENTION

It is an object of the invention to provide a bearing shaft that has a long operating life even under conditions of high load.

This and other objects and advantages of the invention will become obvious from the following detailed description.

SUMMARY OF THE INVENTION

The invention achieves the above objects by the fact that the entire shaft is at first carbonitrided, quenched and tempered so that a hardness of HV 745-950 (HRC 62-68) is realized, following which, the thus treated shaft is soft annealed to produce a hardness of HV 212-305 (HRB 93-HRC 30), and the outer peripheral surface is then subjected to induction hardening to achieve a final hardness of HV 745-950 (HRC 62-68).

The advantage of a shaft produced according to the invention is that the shaft has increased hardness and higher residual compressive stresses in the raceway region so that wear resistance and fatigue strength of the shaft are increased in this region while the ends of the shaft are soft. Carbonitriding is known to the person skilled in the art as a thermochemical method for treating a workpiece in the austenitic state with the aim of enriching the surface layer with carbon and nitrogen, so that these two elements are then in a solid solution in the austenite.

Quenching with the aim of effecting hardening follows directly after carbonitriding. As the person skilled in the art also knows in this connection, carbonitriding results in the formation of a certain layered structure in the form of a connecting layer and below this, a diffusion layer. While the connecting layer determines all the workpiece properties connected with the factors that influence the outermost surface, i.e. the wear behavior and the corrosion resistance of the workpiece, the mechanical properties of the workpiece that relate to fatigue strength and tensile strength are determined by the diffusion layer.

Quenching, i.e. cooling at a very high cooling rate for transforming austenite into martensite, is followed by tempering. By heating to moderately high temperatures and subsequent cooling, internal stresses are reduced. This is accompanied by a reduction of hardness and strength while toughness and ductility are augmented.

Following this, the carbonitrided, quenched and tempered shaft is soft annealed for obtaining the hardness values HV 212-305 (HRB 93-HRC 30), that are the hardness values for the two ends of the shaft. This soft annealing serves particularly to improve the deformation capability of the shaft so that its end regions are easy to deform plastically and can thus be swaged in a reception bore in a simple manner. The annealing temperatures are chosen as a function of the material used in each case and, in the case of steel, they lie approximately between 650 and 700° C. In the final analysis, the aim of soft annealing is to endow the steel with a microstructure that is suitable for hardening and to bring the steel into a soft and easily workable state.

Through the subsequent induction hardening of the outer peripheral surface of the shaft, finally, the desired final hardness of HV 745-950 (HRC 62-68) is obtained in this region. Induction hardening is the most widely used surface layer hardening method at the present. In this method, a current-carrying coil (inductor) is used for creating an alternating magnetic field that induces an alternating current according to the transformer principle in an electrically conductive workpiece (shaft). The direct transformation of electric energy into thermal energy through internal heat sources thus leads to a warming-up of the component, with the transfer of energy taking place without contact. If the activity of the magnetic field is restricted to a short period of time, and quenching is effected immediately, the warming-up is limited mainly to the surface layer in which the internal sources of heat are effective. With an increasing duration, a progressive heating of the component in radial direction is caused as a result of heat conduction. This means that the desired depth of hardening can be defined by simple means and can always be adapted without more ado to the specific case of use.

According to one feature of the invention, the induction hardened outer peripheral surface of the shaft comprises fine, well-dispersed spheroidal carbides in a matrix of tempered martensite, with 5-25% retained austenite.

According to a further feature of the invention, the shaft is solid or has a hollow cylindrical configuration at least in the region of its ends. The advantage of a hollow cylindrical shaft is that, besides a reduction of weight, the widening of the ends during swaging is facilitated.

The shaft of the invention can be used for mounting a roller in an actuating lever in a valve train of an internal combustion engine. Another use of the shaft of the invention is the mounting of a planetary pinion in an automatic transmission of an automotive vehicle.

The invention will now be described with reference to the appended drawings which illustrate one example of embodiment.

DETAILED DESCRIPTION OF THE DRAWINGS

Figure 1:
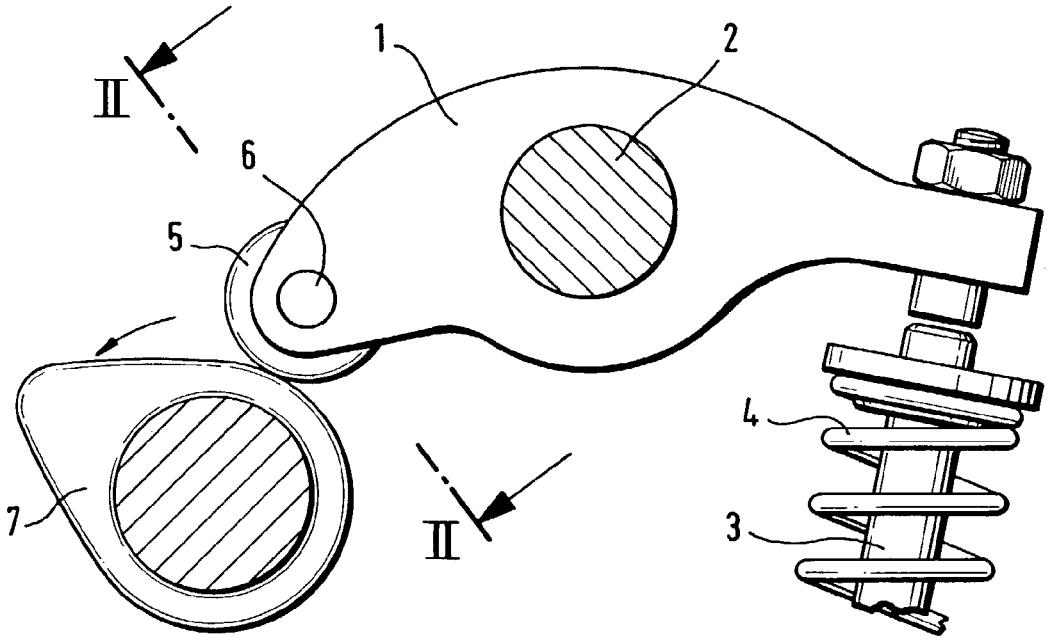
FIG. 1 is a schematic side view of a valve train of an internal combustion engine.

The rocker arm 1 of a valve train of an internal combustion engine shown in FIG. 1 is mounted through its axle 2 for pivoting. At its right end, the rocker arm 1 is operatively connected to the stem of a gas exchange valve 3 that is held in a closed position by the associated spring 4. At the left end, the roller 5 that is in contact with the cam 7 is retained through the shaft 6 in the rocker arm 1. A rotation of the cam 7 provokes a pivoting of the rocker arm 1 about its axle 2 so that the left end of the rocker arm 1 is moved upward while its right end is moved downward and causes the gas exchange valve 3 to open.

Figure 2:
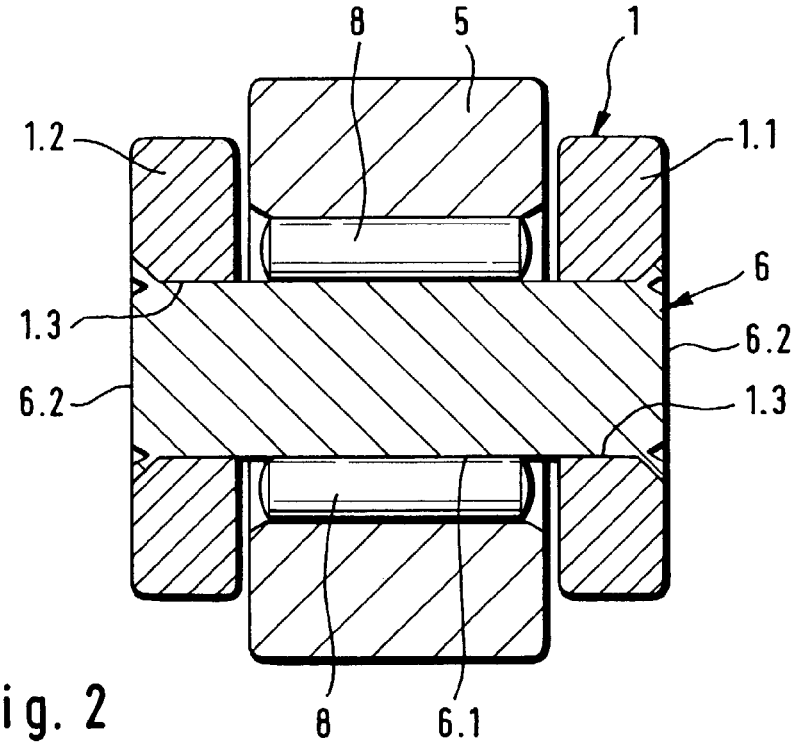
FIG. 2 is a section taken along line II-II of FIG. 1.

As can be seen in FIG. 2, at its left end, the rocker arm 1 comprises a bifurcated section having the spaced side walls 1.1 and 1.2. These side walls 1.1 and 1.2 comprise the aligned bores 1.3 in which the shaft 6 is arranged that carries the roller 5 that is mounted on the rolling element crown ring 8. The shaft 6 defines the inner raceway 6.1 for the rolling element crown ring 8 and is swaged at both its ends 6.2 in the reception bores 1.3 of the side walls 1.1 and 1.2 of the rocker arm 1. By the application of an axial force, material of the shaft 6 is pressed toward the side walls 1.1 and 1.2 so that a positive engagement is made between the shaft 6 and the rocker arm 1. From this figure it can also be understood that, on the one hand, the shaft 6 must be soft to enable it to be swaged at all, and on the other hand, it must have an adequate hardness in the raceway region 6.1 to be able to function as a stable radial bearing under load.

Such a shaft made of a steel of the type 17 MnCr 5 i.e., with 0.17% carbon and 1.25% each of manganese and chromium, is carbonitrided in a gas mixture and then quenched in an oil bath and tempered. By tempering at moderately high temperatures, internal stresses are reduced which means that hardness and strength are likewise reduced while ductility increases. In the microstructure, brittle tetragonal martensite is transformed into more ductile cubic martensite. After the tempering treatment, the shaft has a hardness of HV 800. The shaft is then subjected to soft annealing by which is understood a long-time heating of the steel to temperatures close to the Al point followed by slow cooling. The aim of soft annealing is, on the one hand, to endow the steel with a microstructure suitable for hardening and, on the other hand, to bring the steel into a soft, easily workable state. After soft annealing, the shaft has a hardness of HV 250, which hardness at the same time is the final hardness of the two ends 6.2 of the shaft. This is finally followed in a known manner by a partial induction hardening of the outer peripheral surface of the shaft 6, so that the final hardness of this surface is HV 800.

Figure 3:
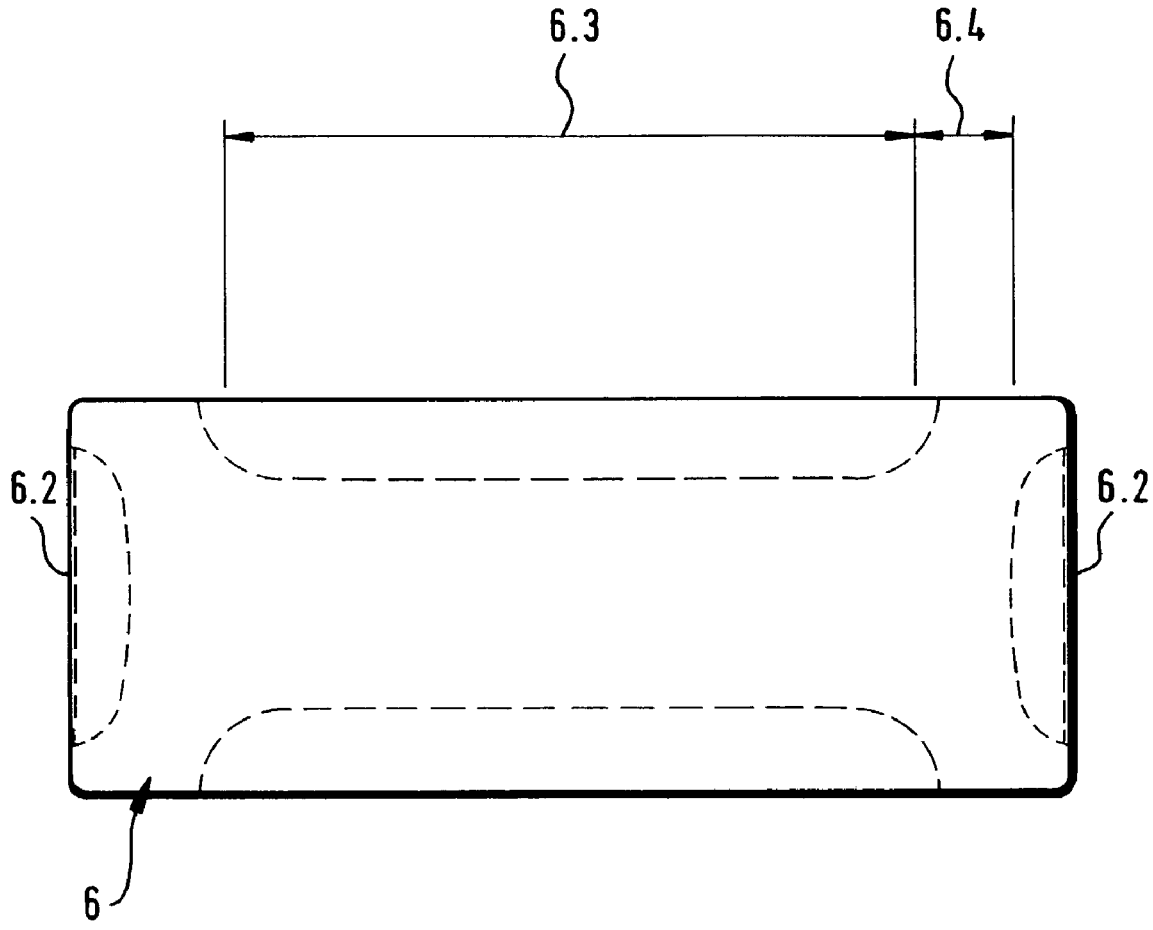
FIG. 3 is an enlarged representation of a shaft of the invention.

Finally, as shown in FIG. 3, the shaft 6 comprises the region 6.3 that serves as a raceway 6.1 for the rolling elements 8. It is this region 6.3 that comprises the microstructure described above that is obtained after induction hardening which means that it comprises fine, well-dispersed spheroidal carbides in a matrix tempered martensite with a retained austenite content of 5-25%. The transition region 6.4 of the shaft 6 separates the hardened region 6.3 from the soft ends 6.2

What we claim is:

1. A bearing shaft with a hardened section serving as a raceway for rolling elements in a reception bore of a housing, at least one end of the shaft being adapted to be swaged to the reception bore for achieving at least one of a force locking and a positive engagement, and an outer peripheral hardened surface of the shaft having a hardness that is greater than a hardness of ends of the shaft, wherein the entire shaft is at first carbonitrided, quenched and tempered so that a hardness of HV 745-950 (HRC 62-68) is realized, following which, the thus treated shaft is soft annealed to produce a hardness of HV 212-305 (HRB 93-HRC 30), and the outer peripheral surface is then subjected to induction hardening to achieve a final hardness of HV 745-950 (HRC 62-68).

2. A shaft of claim 1, wherein, after induction hardening, the outer peripheral surface of the shaft comprises fine, well-dispersed spheroidal carbides in a matrix of tempered martensite, with a retained austenite content of 5-25%.

3. A shaft of claim 1 having a solid configuration.

4. A shaft of claim 1, wherein at least a region of the ends of the shaft has a hollow cylindrical configuration.

5. A shaft of claim 1 used for mounting a roller in an actuating lever of a valve train of an internal combustion engine.

6. A shaft of claim 1 used for mounting a planetary pinion in an automatic transmission of an automotive vehicle.

* * * * *